US006029034A

United States Patent [19]

Itsukushima et al.

[11] Patent Number: 6,029,034

[45] Date of Patent: Feb. 22, 2000

[54] IMAGE FORMING APPARATUS HAVING AN α-SI PHOTOSENSITIVE DRUM AND A NON-MAGNETIC UNI-COMPONENT TONER

[75] Inventors: Keiji Itsukushima; Yoshio Ozawa; Yojiro Sato; Hisashi Mukataka, all of Watarai-gun, Japan

[73] Assignee: Kyocera Corporation, Kyoto, Japan

[21] Appl. No.: 08/882,741

[22] Filed: Jun. 26, 1997

[30] Foreign Application Priority Data

Jun. 28, 1996 [JP] Japan ..... 8-188882

[51] Int. Cl.[7] ..... G03G 9/08; G03G 15/00; G03G 15/08

[52] U.S. Cl. ..... 399/159; 399/149; 399/279; 430/56; 430/83; 430/120

[58] Field of Search ..... 399/159, 161, 399/222, 252, 265, 279, 285, 149, 150, 98, 343; 430/56, 67, 83, 84, 105, 107, 109, 111, 120, 902

[56] References Cited

U.S. PATENT DOCUMENTS

| | | | |
|---|---|---|---|
| 5,587,774 | 12/1996 | Nagahara et al. | 399/149 X |
| 5,610,697 | 3/1997 | Arai | 399/149 |
| 5,679,490 | 10/1997 | Yachi et al. | 430/111 X |
| 5,701,568 | 12/1997 | Hiroshima et al. | 399/302 |

FOREIGN PATENT DOCUMENTS 62-272275 11/1987 Japan .

5-188765 7/1993 Japan .

*Primary Examiner*—Arthur T. Grimley
*Assistant Examiner*—Sophia S. Chen
*Attorney, Agent, or Firm*—Loeb & Loeb LLP

[57] ABSTRACT

The invention seeks to provide an electrophotographic apparatus, which can have a simplified and safe construction in an image forming apparatus using an a-Si photo-sensitive drum and form clear images free from the flow of image or "fog". The image forming apparatus that is sought uses image development a non-magnetic uni-component toner prepared by a polymerization process as a preamble, and is characterized in that a developing roller is rotated in contact with an a-Si photo-sensitive drum via a layer of non-magnetic uni-component toner. The volume resistivity of the developing roller is set to $3\times10^7.\Omega$ cm or below. The photo-sensitive drum has a surface layer with an element ratio composition represented as ($a\text{-}Si_{1-x}C_x$:H), x being $0.95\leqq x<1$, the dynamic push hardness of the outer surface of the surface layer being 300 kgf/mm$^2$ or below, the hardness of the surface layer being set to be higher on the inner side than on the outer surface, and a developing roller is rotated while carrying a non-magnetic uni-component toner prepared by a polymerization process at a peripheral speed different from that of the photo-sensitive drum, thereby causing the carried toner to rub the surface of the photo-sensitive drum for electrophotographic development.

18 Claims, 12 Drawing Sheets

Fig. 6

| Photo-sensitive Drum | | Drum A | | | Drum B | | |
|---|---|---|---|---|---|---|---|
| Item of Evaluation | | Flow of Image | Deterio-ration of Image | Scribing (in angstroms) | Flow of Image | Deterio-ration of Image | Scribing (in angstroms) |
| Durability (number of Copies) | Initial | ○ | ○ | 0 | ○ | ○ | 0 |
| | 5,000 | ○ | ○ | 50 | Δ | ○ | 12 |
| | 10,000 | ○ | ○ | 100 | × | ○ | 22 |
| | 50,000 | ○ | ○ | 500 | × | ○ | 120 |

○ : Flow or deterioration of Image is not recognized

Δ : Flow or deterioration of Image is slightly recognized

× : Flow or deterioration of image is recognized to such extents that troubles may occur in actual practice

Fig. 7

Anti-fog effects of different toner preparation Methods

| White area electric field ( $V_0 - V_B$ ) | Polymerization toner | Commutation toner |
|---|---|---|
| 50V | ● | ● |
| 100V | ● | ● |
| 150V | ● | ● |
| 200V | ○ | ● |
| 250V | ○ | ● |
| 300V | ○ | ○ |

( ● : Fog generated, ○ : No fog generated )

Fig. 8

| Developing roller resistance | Image density |
|---|---|
| $2.0 \times 10^5$ Ωcm | 1.42 |
| $1.5 \times 10^6$ Ωcm | 1.42 |
| $8.7 \times 10^6$ Ωcm | 1.39 |
| $3.0 \times 10^7$ Ωcm | 0.98 |
| $1.2 \times 10^8$ Ωcm | 0.68 |

(The resistance values are under an applied voltage of 500V)

Fig. 9

| Toner layer thickness | Image density | Minimum electric ( $V_0$ - $V_B$ ) for removal | |
|---|---|---|---|
| 0.2 mg / $cm^2$ | 1.10 | 150V | Thin |
| 0.4 mg / $cm^2$ | 1.44 | 200V | |
| 0.6 mg / $cm^2$ | 1.43 | 220V | |
| 0.8 mg / $cm^2$ | 1.42 | 220V | |
| 1.0 mg / $cm^2$ | 1.37 | 300V | |
| 1.2 mg / $cm^2$ | 1.35 | 450V | Fog is liable |

Fig. 10

Image forming status dependent on toner layer

| Toner layer density ( mg / $cm^2$ ) | Potential difference between photo-sensitive drum and developing roller (V) | Result |
|---|---|---|
| 0.2 | 150 | Low image density / Low photo-sensitive drum ⇒ Generation of flow of image |
| 0.4 | 200 | Good |
| 0.6 | 220 | Good |
| 0.8 | 220 | Good |
| 1.0 | 300 | Slight residual toner on photo-sensitive drum / Weak cleaning |
| 1.2 | 450 | Strong fog removal electric field required<br>Generation of toner attachment<br>Weak cleaning |

(Image evaluation was made after forming 5,000 copies under normal temperature and relative humidity conditions and subsequent leaving of the copies under high temperature and relative humidity conditions.)

Fig. 11

Flow-of-image status dependent on peripheral speed ratio of developing roller

| Peripheral speed ratio | Image density | | Result |
|---|---|---|---|
| | Black | White | |
| 0.5 | 1.02 | | Flow of image |
| 1.0 | 1.21 | Great fog | Flow of image |
| 1.2 | 1.40 | | Fairly good |
| 1.5 | 1.42 | | Fairly good |
| 1.8 | 1.43 | | Fairly good |
| 2.0 | 1.43 | | Fairly good |
| 3.0 | 1.43 | | Fairly good |
| 5.0 | 1.42 | | Fairly good |
| 7.0 | 1.36 | | High torque, Insufficient toner charging, Great toner dispersion |

(The toner layer thickness was set to 0.7 $mg/cm^2$ in the measurement)

Fig. 12

Image forming status dependent on developing time

| Linear speed of drum ( mm / sec. ) | Development nip ( mm ) | Developing time ( sec. ) | Result |
|---|---|---|---|
| 150 or over | 1.5 or below | 0.01 or below | Developing efficiency reduced, Rubbing efficiency reduced, Weakly polished, Flow of image |
| 150 ( 24ppm ) | 1.5 | 0.01 | Fairly good |
| 100 ( 16ppm ) | 1 ~ 2 | 0.01 ~ 0.02 | Fairly good |
| 50 ( 8ppm ) | 1 ~ 2 | 0.02 ~ 0.04 | Fairly good |
| 25 ( 4ppm ) | 1 ~ 2 | 0.04 ~ 0.08 | Fairly good |
| 25 or below | 2 or over | 0.08 or over | Great torque |

Fig. 13

Image forming status dependent on potential difference between developing roller and feed roller

| Potential difference between developing roller and feed roller Vt (V) | Toner layer thickness ( mg / $cm^2$ ) | Result |
|---|---|---|
| 30 | 0.2 | Low image density, Low-sensitive drum → Generation of flow of image |
| 50 | 0.4 | Fairly good |
| 100 | 0.6 | Fairly good |
| 200 | 0.8 | Fairly good |
| 300 | 1.0 | Slight residual toner attached, Weak cleaning strong fog removal |
| 400 | 1.2 | Electric field required, Toner attached, Weak cleaning |

(For the flow of image evaluation, image was evaluated by obtaining 5,000 copies under normal temperature and relative humidity conditions and subsequently leaving the copies under high temperature and relative humidity conditions.)

Fig. 14

Composition of transfer efficiency between commutation toner and polymerization toner

| Toner characteristic | Commutation (%) | Polymerization (%) |
|---|---|---|
| Transfer efficiency ( N / N ) | 86 | 98 |
| Transfer efficiency ( L / L ) | 77 | 91 |
| Ghost generation limit Transfer efficiency | 82 | 75 |

IMAGE FORMING APPARATUS HAVING AN α-SI PHOTOSENSITIVE DRUM AND A NON-MAGNETIC UNI-COMPONENT TONER

BACKGROUND OF THE INVENTION

2. Field of the Invention

This invention relates to image forming apparatuses such as printers, copiers and facsimile sets using a photo-sensitive drum made of amorphous silicon (hereinafter referred to as a-Si).

2. Description of the Prior Art

As the electrophotographic apparatus, those based on a Curlson process are well known in the art. In this type of electrophotographic apparatus, as high voltage as 4 to 8 kV or above should be applied by wire application to a photo-sensitive drum for uniformly charging the surface thereof. With this charging, ozone and such discharge products as oxides of nitrogen and ammonium salt are generated and adsorbed to the photo-sensitive drum surface, which readily causes flow of image.

To obviate such drawback, a roller charging system has been proposed, in which a conductive roller is held in contact with a photo-sensitive drum for contact charging thereof by applying a DC voltage to the conductive roller. Even with such charging system, however, slight discharge takes place in minute wedge-like interstices present between the photo-sensitive drum and the charging roller. Actually, generation of ozone is recognized with this system, and the system does not completely obviate the drawback noted above.

In the meantime, for durability improvement and freedom from maintenance, some electrophotographic apparatuses use a-Si photo-sensitive drums. Compared to organic semiconductors, however, a-Si highly absorbs moisture, and the possibility of generation of the flow of image is far high with a-Si photo-sensitive drums.

Where an a-Si photo-sensitive drum is used, therefore, to prevent the flow of image, the drum is heated for moisture removal with a sheet heater or like heater body disposed on the back side of the drum.

However, the provision of a heater necessitates heat control means or the like and complicates the construction. Particularly, in connection with the size reduction and personalization of copiers and printers, the use of a heater seriously complicates the system.

The provision of a heater poses further problems. The heater requires a predetermined warm-up time until it is ready to permit printing after the power connection. Considerable power is therefore consumed. Moreover, when the photo-sensitive drum is heated, it is elevated in temperature up to the TG temperature (i.e., glass transition temperature) of the toner, resulting in attachment of toner to the drum surface.

To solve the above problems, various techniques have been developed, which take the photo-sensitive drum, particularly, a surface layer thereof, into considerations.

For example, Japanese Laid-Open Patent Publication No. 62-272275 shows a photo-sensitive drum having a-Si photoconductive layer covered by a surface layer, which is made of an amorphous material mainly composed of silicon (Si) and carbon (C) and containing oxygen (0), hydrogen (H) and fluorine (F) and has a dynamic penetration hardness of 300 to 1,000 kgf/mm$^2$.

The dynamic penetration hardness is set in the above range because with a dynamic penetration hardness above 1,000 kgf/mm$^2$ the surface layer is readily chemically affected by a high Si content thereof, thus readily resulting in the flow of image.

With a dynamic penetration hardness below 300 kgf/mm$^2$, on the other hand, the photoconductivity of the surface layer is deteriorated due to a high C content thereof. Therefore, the residual potential is increased. In addition, the hardness of the surface layer is considerably reduced, resulting in great wear thereof due to the image copying process so that image defectiveness readily takes place.

The prior art techniques described above have the following problems.

In the first place, the prior art techniques take the sole photo-sensitive drum surface layer into considerations to realize a commonly termed heater-free photo-sensitive drum. However, the flow of image is not only generated on the surface layer, but it is determined by the relation between the surface layer and the photoconductive layer and also by the relation between the photoconductive layer via the surface layer and the processing means.

Therefore, various actual difficulties are encountered when a heater-free photo-sensitive drum is to be realized by specifying the sole surface layer thereof.

Secondly, the prior art techniques seek to eliminate the flow of image particularly under high relative humidity conditions while avoiding wear of the photo-sensitive drum surface layer. However, the flow of image stems from deterioration of the drum surface and also from attachment thereto of discharge products resulting from ozone generation as result of a discharge phenomenon when charging the drum. The deterioration of the drum surface or attachment thereto of discharge products, increases the moisture absorption capacity of the drum surface and reduces the drum surface resistance even under high relative humidity conditions. This causes leaks of electrostatic latent image in the axial direction, thus resulting in the flow of image. Therefore, irrespective of any contrivance concerning the surface layer, for instance, discharge products are accumulated on the surface layer of the drum in the use thereof, and eventually the flow of image is generated. It is thus difficult to ensure stable image formation for long time.

In order to provide a heater-free photo-sensitive drum, the applicant has proposed an electrophotographic apparatus for image forming by uniformly charging a photoconductive layer supported on a base by such means as a discharge phenomenon, then exposing the photoconductive layer to write an exposure image thereon, and developing the written exposure image by inversion development. The photoconducitve layer is an a-Si layer with a thickness of 25 μm or below, preferably 2 to 20 μm, and is charged to a surface potential of substantially 360 V or below (Japanese Laid-Open Patent Publication No. 7-17526).

This prior art technique, however, takes the relation between the surface layer and the photoconductive layer into no consideration.

In the meantime, comminution toners have heretofore been used. The comminution toner is prepared by cooling down a paste obtained by kneading a mixture of small particles of a resin, a coloring material, a charging controller, etc., coarsely comminuting the cooled-down paste using a hammer mill, a cutter mill, etc., and then finely comminuting the resultant particles to a particle size of 8 to 15 μm using a jet mill or the like.

The comminution toner particles, therefore, have distorted shapes with raised and recessed portions. Consequently, their charging is concentrated in the raised portions. In addition, a single toner particle may be in contact with the photo-sensitive drum surface in a plurality of raised portions. In such a case, the mirror image force is increased.

As a further problem, a-Si is readily subject to a phenomenon commonly termed "fog", i.e., attachment of toner to white areas. In this phenomenon, toner is attached to the photo-sensitive drum surface by the mirror image force or like forces.

The mirror image force of the toner is greatly affected by relative dielectric constant of the photo-sensitive layer and the higher the relative dielectric constant is the greater the mirror image force is. With organic photo-sensitive materials the relative dielectric constant is about 3 to 3.5, whereas with a-Si it is as great as about 10 to 12. This is why a-Si is readily subject to the phenomenon of "fog".

SUMMARY OF THE INVENTION

An object of the invention is to provide an electrophotographic apparatus, which can have a simplified and safe construction in an image forming apparatus using an a-Si photo-sensitive drum and form clear images free from the flow of image or "fog".

Another object of the invention is to provide an image forming apparatus, which can remove dust particles generated from the recording medium to form satisfactory images.

To attain this object, according to the invention an image forming apparatus is provided, which uses for image development a non-magnetic uni-component toner prepared by a polymerization process as a preamble, and is characterized in that a developing roller is rotated in contact with an a-Si photo-sensitive drum via a layer of non-magnetic uni-component toner, the volume resistivity of the developing roller being set to $3\times10^7.\Omega$ cm or below, the development being performed with the formation of the non-magnetic uni-component toner layer on the developing roller.

Particularly, according to the invention the a-Si photo-sensitive drum has a surface layer having an element ratio composition represented as a-$Si_{1-x}C_x$:H, x being $0.95\leqq x<1$, the dynamic penetration hardness of push harness of the outer surface of the drum being set to 300 kgf/mm$^2$ or below, the hardness of the surface layer being set such as to be increased as one goes inward from the outer surface, the non-magnetic uni-component toner being polymerization prepared, the surface layer being caused to rub the photo-sensitive drum with a peripheral speed difference relative thereto with rotation of the developing roller carrying the toner, the surface potential on the photo-sensitive drum being set to approximately 400 V or below, the developing bias voltage applied to the developing roller being set to approximately 150 V or below.

According to the invention, the toner particles prepared by the polymerization process, which are carried as a thin layer on the developing roller for developing a latent image formed on the photo-sensitive drum, are substantially spherical in shape and can be charged uniformly. In addition, they are in point contact with the photo-sensitive drum surface, that is, they are in contact, in a fewer number of points, with the drum surface, thus reducing the mirror image force and effectively preventing the phenomenon of "fog".

Moreover, with the volume resistivity of the developing roller set to be as low as $3\times10^7.\Omega$ cm or below, it is possible to prevent an excessive voltage drop across the roller layer, and with this effect, together with the effect of the low relative dielectric constant of the a-Si photo-sensitive drum, it is possible to set the surface potential on the photo-sensitive drum to 400 V or below and the developing bias potential applied to the developing roller to 150 V or below. It is thus possible to reduce the thickness of the photo-sensitive drum to 25 $\mu$m or below and provide an inexpensive electrophotographic apparatus.

More specifically, as shown in an enlarged showing A in FIGS. 1 and 5, the a-Si photo-sensitive drum has a conductive base 1*a* in the form of an aluminum cylinder, and a photoconductive layer 1*b* and a surface layer 1*c* laminated on the base layer 1*a*. The surface layer 1*c* is made of an a-Si system inorganic high resistivity or insulating material for maintaining the surface potential $V_0$ on the photoconductive layer 1*b* and the latent image potential distribution.

As shown in FIG. 3, the non-magnetic uni-component toner, unlike the magnetic brush developing process using the ordinary magnetic toner, is capable of adjusting its density with the bias voltage, and the surface potential $V_0$ on the photo-sensitive drum draws a curve 13 in relation to the developing roller with synchronous relative rotations of the photo-sensitive drum and the developing roller. With the developing bias voltage set to $V_B$, an image dot at this time is as shown by reference symbol 13A.

When the flow of image is generated, the surface potential $V_0$ is changed as shown by a curve 14. The image dot at this time, is as shown by reference symbol 14A, with "blur" generated around the real image.

According to the invention, the developing roller is rotated in contact with the photo-sensitive drum, and its volume resistivity is set to $3\times10^7.\Omega$ cm or below. It is thus possible to prevent excessive voltage drop across the developing roller, and with the combined effect of this effect and the low relative dielectric constant of the a-Si photo-sensitive drum, the surface potential on the photo-sensitive drum and the developing bias voltage applied to the developing roller can be set to low levels. Specifically, as shown in FIG. 3, the developing bias voltage is set to $V_{B'}$ instead of $V_B$, that is, it is set to low level, at which the image dots 14B and 13B with and without generation of the flow of image, respectively, coincide with each other.

In the prior art, sufficient image density could not be obtained even with $V_B$-$V_{L'}$, whereas according to the invention sufficient image density could be obtained with $V_{B'}$-$V_L$.

Consequently, according to the invention it is possible to set the surface potential on the photo-sensitive drum approximately to 400 V or below, preferably 300 to 350 V, and set the developing bias voltage applied to the developing roller approximately to 150 V or below, preferably 80 to 120 V. It is thus possible to set the thickness of the photo-sensitive drum to 25 $\mu$m or below and provide an inexpensive electrophotographic apparatus. Besides, image formation without generation of the flow of image can be obtained without provision of any heater on the back side of an aluminum cylinder or like base supporting the photo-sensitive drum.

According to the invention, the non-magnetic uni-component toner which is prepared by the polymerization process, is caused to rub the photo-sensitive drum with a peripheral speed difference relative thereto by rotating the developing roller carrying the toner, and the electrophotographic development is done while the photo-sensitive drum surface layer is polished by the toner particles.

This has an effect that discharge products adsorbed together with moisture or the like to the photo-sensitive drum surface layer are positively polished by the toner or abrasive carried by the developing roller. Besides, the hardness of the surface layer is set such that it is higher on the inner side than on the outer surface, preferably such that it is gradually increased as one goes inward. Thus, not only the adsorbed discharge products but also the outer surface layer is scraped off, the scraping being gradually reduced as one goes inward. In other words, the scraping or polishing does not proceed down to the photoconductive layer, and it is possible to ensure long life and high durability of the photo-sensitive drum.

According to the invention, the development is done by the developing roller in contact with the photo-sensitive drum. Therefore, paper particles remaining attached to the photo-sensitive drum surface after the transfer of a toner image carried on the drum surface onto a recording sheet, disables satisfactory development when they return to the developing position.

According to the invention, paper particle removing means is disposed on the photo-sensitive drum between the transferring position and the developing position, and the density of the toner layer accumulated on the developing roller is set to 0.3 to 0.9 mg/cm$^2$ at the developing position.

The peripheral speed of the transfer roller is set to be different from, i.e., higher than, the peripheral speed of the photo-sensitive drum. With this arrangement, a dynamic pushing pressure is applied to the back side of the recording sheet, and the back side of the recording sheet is pushed by a wide area of the transfer roller. It is thus possible to improve the transfer efficiency.

According to the invention, a feed roller which is rotated in frictional contact with the developing roller for supplying toner is disposed in a developer vessel. The feed roller is rotated in the same direction as the developing roller, thus providing counter feed rotations (i.e., opposite direction rotations) of the two rollers that face each other. With this arrangement, the residual toner remaining on the developing roller after the development can be smoothly removed, while sufficiently agitated fresh toner is supplied to the developing roller. Particularly, according to the invention the old non-magnetic uni-component toner may become stagnant at the developing position due to the contact of the developing roller and the photo-sensitive drum with each other via the non-magnetic uni-component toner, but the above arrangement permit fresh toner to be supplied to the developing position at all times for image formation.

The toner can be electrostatically agitated by applying between the developing roller and the toner feed roller a toner feed voltage, which is of the same polarity as the tribo-electrificational electrode of the toner and is set to 30 to 300 V, preferably 40 to 250 V, more preferably 50 to 200 V.

By causing the developing roller to be rotated at 1.2 to 5.0 times to the peripheral speed of the photo-sensitive drum at the position of contact between the photo-sensitive drum and the developing roller and providing the developing roller with an elastic cover, it is possible with the friction of the developing roller to rub off the residual toner stagnant at the developing position and always supply fresh toner thereto.

By setting the time of contact between the photo-sensitive drum and the developing roller to 0.01 to 0.1 second, preferably 0.01 to 0.08 second, satisfactory image formation can be obtained.

BRIEF DESCRIPTION OF THE DRAWINGS

FIG. 6 is a table showing the results of image evaluation and scraping evaluation of photo-sensitive drums A and B;

FIG. 7 is a table showing anti-fog effects due to difference of polymerization toner from comminution toner;

FIG. 8 is a table showing the relation between developing roller resistance and image density;

FIG. 9 is a first table showing image formation statuses with different toner layer thicknesses (or densities);

FIG. 10 is a second table showing image formation statuses with different toner layer thicknesses (or densities);

FIG. 11 is a table showing image formation statuses with different peripheral speed ratios of a developing roller;

FIG. 12 is a table showing image formation statuses with different linear speeds of a drum, developing nips and developing times;

FIG. 13 is a table showing image formation statuses with different feed bias between developing roller and feed roller and toner layer thicknesses; and FIG. 14 is a table showing comparison of transfer efficiency between comminution toner and polymerization toner.

DESCRIPTION OF THE PREFERRED EMBODIMENT

An embodiment of the invention will now be described in detail with reference to the drawings. Unless particularly specified, the sizes, materials, shapes, relative dispositions, etc. of constituent parts described in the description of the preferred embodiment, have no sense of limiting the invention but are merely exemplary.

Figure 1:
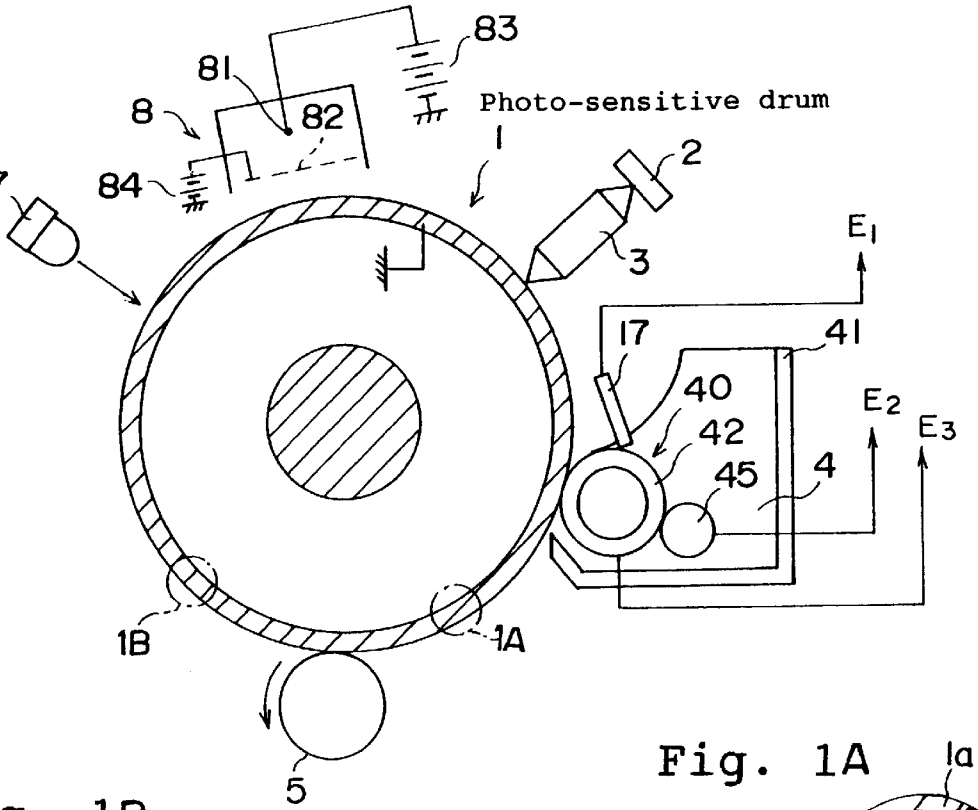
FIG. 1 is a schematic view showing a first embodiment of the image forming apparatus according to the invention.

FIG. 1 shows an electrophotographic apparatus embodying the invention. Referring to the figure, reference numeral 1 designates an a-Si photo-sensitive drum 1 which is rotated in the clockwise direction in the figure. An optical system including an LED head 2 for exposing and a Cellfoc lens 3, a developing unit 4, a transfer roller 5, a discharging lamp 7 and a charging unit 8, are disposed around the photo-sensitive drum 1 in the mentioned order in the direction of rotation of the drum 1.

Various constituent elements will now be described.

Figure 1A:
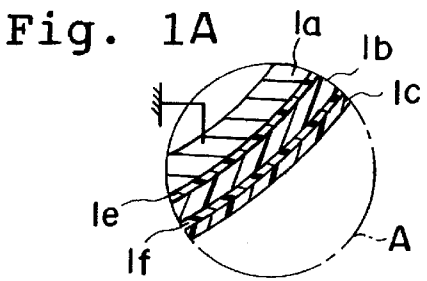
FIG. 1A is a partially enlarged cross-sectional view of laminated layer of a photo-sensitive drum in accordance with one embodiment of the present invention.

The photo-sensitive drum 1, as shown by an enlarged cross-sectional view A in FIG. 1A, includes a conductive base 1*a*, a photoconductive layer 1*b* and a surface layer 1*c* laminated on the base 1*a*, a carrier injection prevention layer 1*e* intervening between the conductive base 1*a* and the photoconductive layer 1*b*, and a transition layer 1*f* intervening between the photoconductive layer 1*b* and the surface layer 1*c*.

The conductive base 1*a* is usually an aluminum cylinder, but it may be formed as well with such metallic materials as SUS, Ti, Ni, Au, Ag, etc., such inorganic materials as glass with a conductive film covering the surface, and transparent resins such as epoxy. In this embodiment, an aluminum cylinder is used, which has a thickness of 3 mm, an outer diameter of 30 mm, and a length or axial dimension of 254 mm.

The carrier injection prevention layer 1*e* may be formed with various materials in dependence on the material of the photoconductive layer 1*b*. Where the photoconductive layer 1*b* is made of an a-Si system material, the carrier injection prevention layer 1*e* is suitably also made of an a-Si system material.

The a-Si system photoconductive layer 1*b* may be formed by means of a glow discharge analysis process, a sputtering process, ECR process, an evaporation process, etc. It is suitably formed by introducing 5 to 40% by weight of a dangling bond termination element such as hydrogen (H) or a halogen element.

Specifically, the photoconductive layer 1*b* is made of a photoconductive material represented as a-Si:H. Where the developing bias is positive, the material is suitably non-doped or doped with a Va family element in order to increase the electron mobility. Where the developing bias is negative, the material is suitably doped with a IIIa family element in order to increase the positive hole mobility. Such elements as C, O and N may, if necessary, be introduced in order to obtain desired characteristics as electric characteristics such as the dark conductivity or photoconductivity or optical characteristics such as the optical band gap.

For ensuring necessary charging and insulation breakdown voltage, absorbing exposure light, suppressing the residual potential, etc., the overall thickness of the photoconductive layer 1*b* is suitably set to about 3 to 40 $\mu$m.

The surface layer 1*c* is formed by means of a glow discharge analysis process, a sputtering process, an ECR process, an evaporation process, etc. It has a hydroxylic amorphous silicon carbide represented as an element ratio composition, a-$Si_{1-x}C_x$:H, x is $0.95 \leqq x < 1$, and its outer surface (i.e., free surface) has a dynamic penetration hardness of 50 to 200 kgf/mm$^2$. Particularly, its resistivity is set to $10^{12}$ to $10^{13}\Omega$ cm. The surface layer 1*c* is set such as to be gradually increased as one goes inward the side of photoconductive layer 1*b* from the side of the outer surface.

The above hardness gradient (i.e., the gradient with which the hardness of the photoconductive layer 1*b* is increased as one goes inward the side of photoconductive layer 1*b* from the outer surface) is provided, for instance in the case of forming the surface layer 1*c* in the glow discharge analysis process, by gradually increasing the ratio of C-containing gas to Si-containing gas in the material gas, gradually increasing the gas pressure while the layer is formed, gradually reducing the rate of dilution of the material gas by the hydrogen gas, gradually reducing the discharge electric power, gradually reducing the temperature of the aluminum cylinder drum base, and so forth.

The thickness of the surface layer 1*c* is 0.4 to 1.2 $\mu$m, preferably 0.5 to 0.8 $\mu$m. Since the surface layer 1*c* is polished, with a thickness below 0.4 $\mu$m a sufficient hardness gradient cannot be obtained. The durability, therefore is deteriorated, resulting in image streaks or the like with increase of the number of copies. With a hardness of above 1.2 $\mu$m, on the other hand, the residual potential on the photoconductive layer 1*b* is increased, thus readily resulting in image fog or the like.

The transition layer 1*f* between the photoconductive layer 1*b* and the surface layer 1*c* suitably has a composition of a-SiC:H with a C content thereof less than the C content of the surface layer 1*c*.

The C content of the transition layer 1*f* may be varied in the layer to provide a content gradient. Such transition layer 1*f* permits smooth movement of photo-carriers generated in the photoconductive layer 1*b*, thus increasing the photosensitivity, reducing the residual potential and improving the image characteristics.

The thickness of the transition layer 1*f* is set to 1 $\mu$m or below, preferably 0.05 to 0.5 $\mu$m.

The surface layer 1*c* may have a double-layer structure instead of the single-layer structure.

Figure 1B:
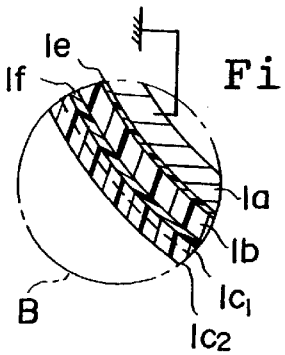
FIG. 1B is a partially enlarged cross-sectional view of laminated layers of the photo-sensitive drum in accordance with another embodiment of the present invention.

For example, as shown by an enlarged cross-sectional view B in FIG. 1B, the surface layer 1*c* may have a first sub-layer $1c_1$ on the side of the photoconductive layer 1*b* and a second layer $1c_2$ on the side of the free surface. Where the second sub-layer $1c_2$ has an element ratio composition given as a-$Si_{1-x}C_x$:H, suitably x is set to $0.95 \leqq x < 1$, the dynamic penetration hardness is set to 50 to 200 kgf/mm$^2$, the thickness is set to 800 to 3000 angstroms. The hardness of the first sub-layer $1c_1$, which is on the inner side as shown in the enlarged showing B, is suitably set to be higher than the hardness of the second sub-layer $1c_2$. Specifically, the dynamic penetration hardness of the sub-layer $1c_1$ is suitably set to 300 kgf/mm$^2$ or above, i.e., a hardness, with which the surface layer 1*c* will not be worn out by polishing with an abrasive.

The second sub-layer $1c_2$ is adequately polished by the developing roller to remove discharged products or the like adsorbed to its surface, and further polishing after the surface has been smoothed is prevented by the first sub-layer $1c_1$ on the inner side. It is thus possible to attain further life extension of the photo-sensitive drum 1.

The thickness of the first sub-layer $1c_1$ is set at will such that the overall thickness of the surface layer 1*c*, inclusive of the second sub-layer $1c_2$, is 0.4 to 1.2 $\mu$m, preferably 0.5 to 0.8 $\mu$m.

In this embodiment, the a-Si:H photoconductive layer 1*b* and the a-SiC surface layer 1*c* are laminated successively by using a capacitance-coupled glow discharge analysis apparatus. By so doing, the photo-sensitive drum 1 may be manufactured by setting the thickness of the photoconductive layer 1*b* to, for instance, 15, 25, 40 and 60 $\mu$m. In this case, suitably the surface layer 1*c* is formed as a single layer instead of the double-layer structure having the first and second sub-layers, and its thickness is set to 0.6 $\mu$m.

As the LED head 2 for exposing, a head array with an exposure wavelength of 685 nm is used and dynamically driven for dividing exposure for 40 times 64 bits for each scan line.

The developing unit 4 includes a developer vessel 41 accommodating the non-magnetic uni-component toner, a developing roller 40 formed by covering an aluminum cylinder or like core member with an elastic member 42 made of polyurethane rubber or like elastic material, a thickness regulating blade 17 for regulating the thickness of the toner layer formed on the developing roller 40, and a feed roller 45 for supplying toner to the developing roller 40. For carrying out the development, the thickness regulating blade 17, the feed roller 45 and the developing roller 40 are connected to output terminals E1 (at 350 V), E2 (at 350 V) and E3 (at 120 V) of a variable DC bias supply, the bias voltage of which is variable between 50 and 500 V.

The toner used is a highly resistive or insulating non-magnetic uni-component toner which is prepared by a polymerization process. The particles of the polymerization toner is obtained by introducing a coloring agent, a charging control agent, etc. into polymer particles in a stage of polymerization of monomer into polymer. Thus, they are spherical in shape, are charged uniformly, and are each in point contact, i.e., in contact at a smaller number of points for one particle, with the photo-sensitive drum surface. The mirror image force is thus low.

The toner contains, for instance, a binder resin, a coloring agent, a charging control agent, an anti-off-set agent, etc., and its mean particle diameter is about 5 to 15 $\mu$m.

The toner may further incorporate an abrasive/fluidizer. The abrasive/fluidizer may be conductive titanium oxide, which has a specific surface of 40 to 60 $m^2/g$, a resistivity of $10^3.\Omega$ cm, a hydrophobicity of 0%, a moisture content of 1.0%, a surface treating Sd doping of $SiO_2$, and a mean particle diameter of 0.1 $\mu$m (hereinafter referred to as abrasive A), or conductive titanium oxide, which has a specific surface of 10 to 15 $m^2/g$, a resistivity of $10^3.\Omega$ cm, a hydrophobicity of 0%, a moisture of 0.5%, a surface treating Sd doping of $SiO_2$, and a mean particle diameter of 0.3 $\mu$m (hereinafter referred to as abrasive B).

The developing roller 40 is rotated in contact with the surface of the photo-sensitive drum 1 with a nip width of 0.5 mm or above, preferably 1 mm or above. At the contact position, the developing roller 40 is rotated in the same direction as the drum 1 (i.e., in the direction of forward feed rotation) and at 1.2 times or above to the peripheral speed of the drum 1.

Thus, at the boundary where the nip contact between the photo-sensitive drum 1 and the developing roller 40 got out of place, the surface layer 1*c* of the drum 1 is polished with toner or abrasive by developing bias before the execution of a developing process.

As the transfer roller 5, a conductive roller is used to improve the transfer efficiency. With a transfer bias of the opposite polarity to the charging potential on the toner applied to it, the transfer roller 5 can be rotated in synchronism with the photo-sensitive drum 1 and in uniform pressure contact with the drum periphery.

As the charging unit 8, a well-known scorotron charger is used to uniformly charge the photo-sensitive drum 1. Reference numeral 81 designates a corona discharge wire, 82 a control grid, 83 a discharge bias supply, and 84 a charging control bias supply.

In the above construction of the embodiment, the bias applied to the charging unit 8 from the charging control bias supply 84 is adequately set to about 150 to 1,200 V. The surface potential on the photo-sensitive drum 1 is set to $V_0$ noted above by applying a high bias voltage to the drum 1 from the discharge bias supply 83, and then a given latent image is formed on the drum 1 by exposure with the exposing head 2 and developed by the developing unit 4 into a toner image to be transferred onto the transfer roller 5.

Toner and abrasive which remain on the photo-sensitive drum 1 without being transferred onto the transfer roller 5, is brought into contact again with the elastic rubber roller 42 of the developing roller 40.

Since the developing roller 40 is being rotated at a higher peripheral speed than the photo-sensitive drum 1 at the contact position therewith, its elastic rubber roller 42 of developing roller 40 causes the residual toner and abrasive to polish the surface of the drum 1.

The residual toner remaining without being transferred onto the transfer roller 5, is brought into contact again with the elastic rubber roller 42 of the developing roller 40.

Since the developing roller 40 is being rotated at a higher peripheral speed than the photo-sensitive drum 1 at the contact position therewith, its elastic rubber roller 42 scribes off the residual toner, while the latent image on the surface of the drum 1 is developed by fresh toner.

Figure 3:
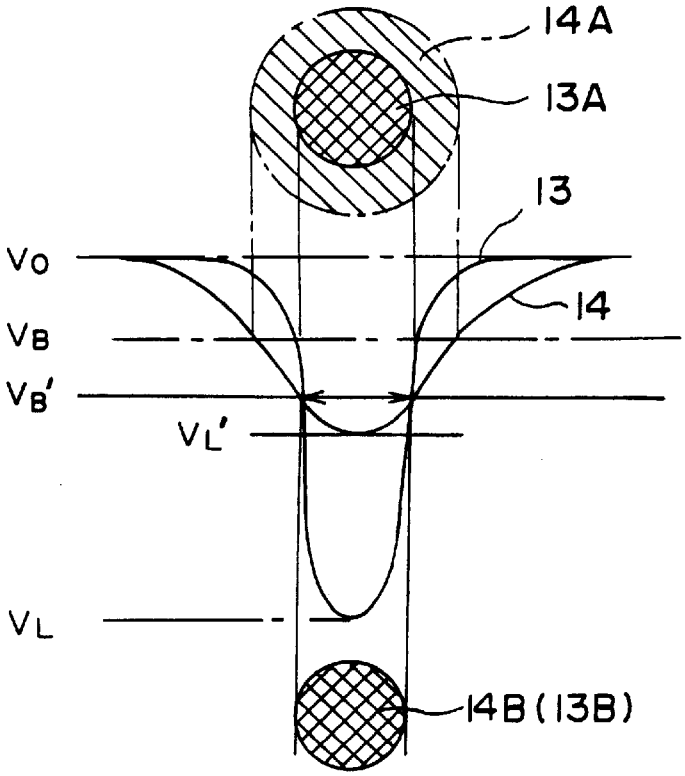
FIG. 3 is a view for describing the phenomenon of "fog" due to flow of image.

In this embodiment, as described before, the surface layer of the photo-sensitive drum is formed as an a-Si layer, and the volume resistivity of the developing roller in rolling contact with the surface layer is set to $3\times10^7.\Omega$ cm or below. Thus, it is possible to prevent an excessive voltage drop across the roller layer, and this effect, in combination with the low relative dielectric constant of the a-Si photo-sensitive drum, permits setting the surface potential on the drum and the developing bias voltage applied to the developing roller to low levels. For example, as shown in FIG. 3, the drum surface potential may be set to $V_{B'}$, which is lower than $V_B$, and at which image dots 14B and 13B, with and without generation of the flow of image, respectively, coincide with each other. As described above, in the prior art sufficient image density could not be obtained even with $V_B$-$V_{L'}$, but the embodiment permitted a sufficient image density to be obtained with $V_{B'}$-$V_L$.

With this embodiment, it is thus possible to set the surface potential on the photo-sensitive drum to 300 to 350 V and the developing bias voltage applied to the developing roller to 80 to 120 V.

As shown above, in this embodiment the developing roller 40 is rotated at a different peripheral speed from that of the photo-sensitive drum 1 to cause toner or toner and abrasive to rub and polish the drum surface layer, while making development. Thus, it is not necessary to provide a special friction roller or cleaning blade, and the construction can be simplified.

In addition, with the rotation of the developing roller 40 at a higher peripheral speed than that of the photo-sensitive drum 1, the polishing area of the developing roller 40 is broad with respect to the polished area of the drum 1. Thus, even when the density of toner held on the developing roller periphery is fluctuated, the extent of polishing can be averaged to obtain satisfactory polishing.

Furthermore, with the nip width of contact between the developing roller 40 and the photo-sensitive drum 1 set to 0.5 mm or above, an effective polishing area of the developing roller 40 can be secured to remove by polishing the such discharge products as nitric acid ions and ammonium ions, which are generated by corona discharge being adsorbed to minute drum surface interstices. It is thus possible to eliminate the flow or image and the fog.

Moreover, in this embodiment, as described before, the hardness of the surface layer 1*c* is set such that it is increased as one goes inward from the outer surface toward the photoconductive layer 1*b*. With this structure, the scraping is gradually reduced, and after the lapse of a predetermined time, molecular ends and minute interstices have been removed to obtain a smooth surface. Adsorption of discharge products thus can be suppressed.

For polishing the surface layer 1*c*, an abrasive is suitably used, which has a particle diameter ranging from 0.05 to 5 $\mu$m, preferably from 0.1 to 3 $\mu$m.

The embodiment thus permits image formation free from generation of fog or the like to be obtained without use of any heater. It is thus possible to reduce electric circuits such as a heater controller and simplify the circuit construction. In addition, without use of any heater no warm-up time is required, thus permitting great reduction of the rise time of the apparatus.

Effects of the invention were confirmed by conducting experiments as follows.

EXAMPLE 1

Two a-Si photo-sensitive drums for electrophotography with a thickness of 25 μm were prepared, which each comprised a photo-sensitive surface layer with an element ratio composition given as a-$Si_{1-x}C_x$:H. In one of these drums, x was set to 0.97, and the dynamic penetration hardness of the outer surface was set to 80 kgf/mm$^2$ (this drum being hereinafter referred to as embodiment photo-sensitive drum A). In the other drum, x was set to 0.75, and the dynamic penetration hardness of the outer surface was set to 300 kgf/mm$^2$ (this drum being hereinafter referred to as contrast photo-sensitive drum B). In these drums, the hardness was set such that it is gradually increased as one goes inward from the outer surface.

The dynamic penetration hardness was measured with a super-miniature hardness gauge ("DUH-201", manufactured by Shimazu Seisakusho).

With these photo-sensitive drums A and B, the flow and deterioration of image and scraping were examined under the following measuring conditions.

(Measuring conditions)

The charging was made with a scorotron system with $V_0$ set to 300 to 350 V. The development was made with a non-magnetic uni-component developer system. As the developing roller was selected one with a diameter of 18 mm, a resistivity of $10^6$ to $10^7$.Ω cm, and a surface roughness of 10 microns or below. The developing nip was set to about 1 mm. As the thickness regulating blade was used one with a thickness of 1.3 mm, and a resistivity of $10^4$.Ω cm or below. As the feed roller was used one with a diameter of about 12 mm, and a resistivity of $10^4$.Ω cm or below, and its nip with respect to the developing roller was set to about 1 mm. As biases, 100 V was applied to the developing roller, 350 V to the thickness regulating blade, and 350 V to the feed roller. As the toner was used a polymerization toner composed of a styrene acryle type material, with a mean particle diameter of 8 microns, and containing the abrasive noted above. The transfer current in the transfer roller 5 was set to 20 to 30 micro-amperes.

FIG. 6 shows results of evaluation of image and scraping with these photo-sensitive drums.

As is seen from the figure, with the embodiment photo-sensitive drum A neither flow of image nor deterioration thereof was recognized, indicating that high quality image recording is obtainable.

In addition, this drum was proved to be free from such problems as image density reduction, fog generation, contrast reduction and image resolution reduction.

With the contrast photo-sensitive drum B, generation of the flow of image was recognized after production of about 5,000 prints. It is also seen that with further printing the flow of image was generated to such extents that troubles might occur in actual practice.

With the embodiment photo-sensitive drum A for electrophotography which has the a-SiC:H surface layer, the scraping was found to be 400 angstroms after production of 50,000 prints and slightly greater than that of the contrast photo-sensitive drum B, which was 120 angstroms. However, with respect to the image characteristics and electrophotographic characteristics no deterioration was recognized, and further it was recognized that the photo-sensitive drum A has sufficient durability.

Since the hardness of the photoconductive layer of the photo-sensitive drum A is increased as one goes inward and also the scraping of the surface layer is gradually reduced as is seen from the results of tests shown in FIG. 6, the photo-sensitive drum A has sufficient durability that it permits further printing without any problem.

Thus, with the embodiment photo-sensitive drum, it was recognized that it is possible to prevent without heating the photo-sensitive drum from the flow of image under high relative humidity conditions generated with further printing and also the photo-sensitive drum has a sufficient durability.

EXAMPLE 2

In this example, the same conditions for measurement as in Example 1 were set except for that the volume resistivity of the developing roller was set to $5\times10^6$.Ω cm.

Figure 2:
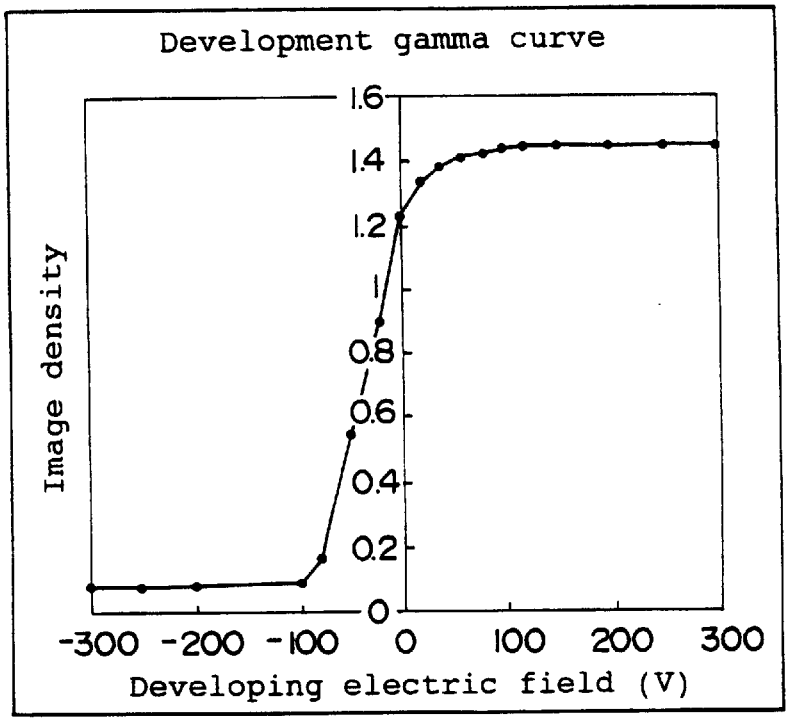
FIG. 2 is a graph showing the relation between image density and developing electric field.

Under these conditions, the image density was measured by varying the developing bias $V_B$ between 50 and 400 V. The results are shown in FIG. 2. In the graph, the ordinate is taken for the image density, and the abscissa is taken for the developing electric field (V). As is seen from the graph, a stable image density of 1.4 could be obtained by setting the developing electric field (V) to 50 V or above.

Under the same conditions, comparison of the polymerization toner and the comminution toner was made concerning the fog generation by varying the white area electric field ($V_0$-$V_B$). As shown in FIG. 7, with the comminution toner, fog was generated when the developing electric field (V) was in a range of 50 to 250 V. With the polymerization toner, however, it was generated when the developing electric field (V) was only in a range of 50 to 150 V. It will be seen that the polymerization toner is far superior in the anti-fog effect.

FIG. 8 shows the image density measured under the above conditions by varying the bias voltage 120 V applied to the developing roller. As is seen, the image density was insufficient with a developing roller volume resistivity above $3\times10^7$.Ω cm, but it was sufficient with a volume resistivity below this value.

FIG. 9 shows the image density measured under the above conditions by varying the thickness of the toner layer formed on the developing roller with the adjustment of the thickness regulating blade.

As is seen from the figure, with a toner layer thickness of 0.2 mg/cm$^2$, the minimum fog-free electric field was low, and the image density was low. With a toner layer thickness of 1.2 mg/cm$^2$, the minimum fog-free electric field was high, and it was impossible to obtain development in a low electric field. Consequently, the image density was high, and fog generation was liable.

It will be seen that for obtaining satisfactory image density the toner layer thickness on the developing roller is 0.4 to 1.0 mg/cm$^2$, preferably 0.4 to 0.8 mg/cm$^2$.

EXAMPLE 3

In this example, the same conditions for measurement as in Example 1 were set except for that a photo-sensitive drum was prepared, which comprises a surface layer having an element ratio composition given as a-$Si_{1-x}C_x$:H, x being $0.95\leqq x<1$, and an outer surface dynamic penetration hardness of 300 kgf/mm$^2$, the hardness of the surface layer being increased as one goes inward from the outer surface.

Under these conditions, 5,000 prints were produced at normal temperature and then left for over 8 hrs. at a temperature of 33° C. and under a relative humidity of 85%, and then image evaluation was made to find that the images obtained were satisfactory and free from flow of image.

Figure 5:
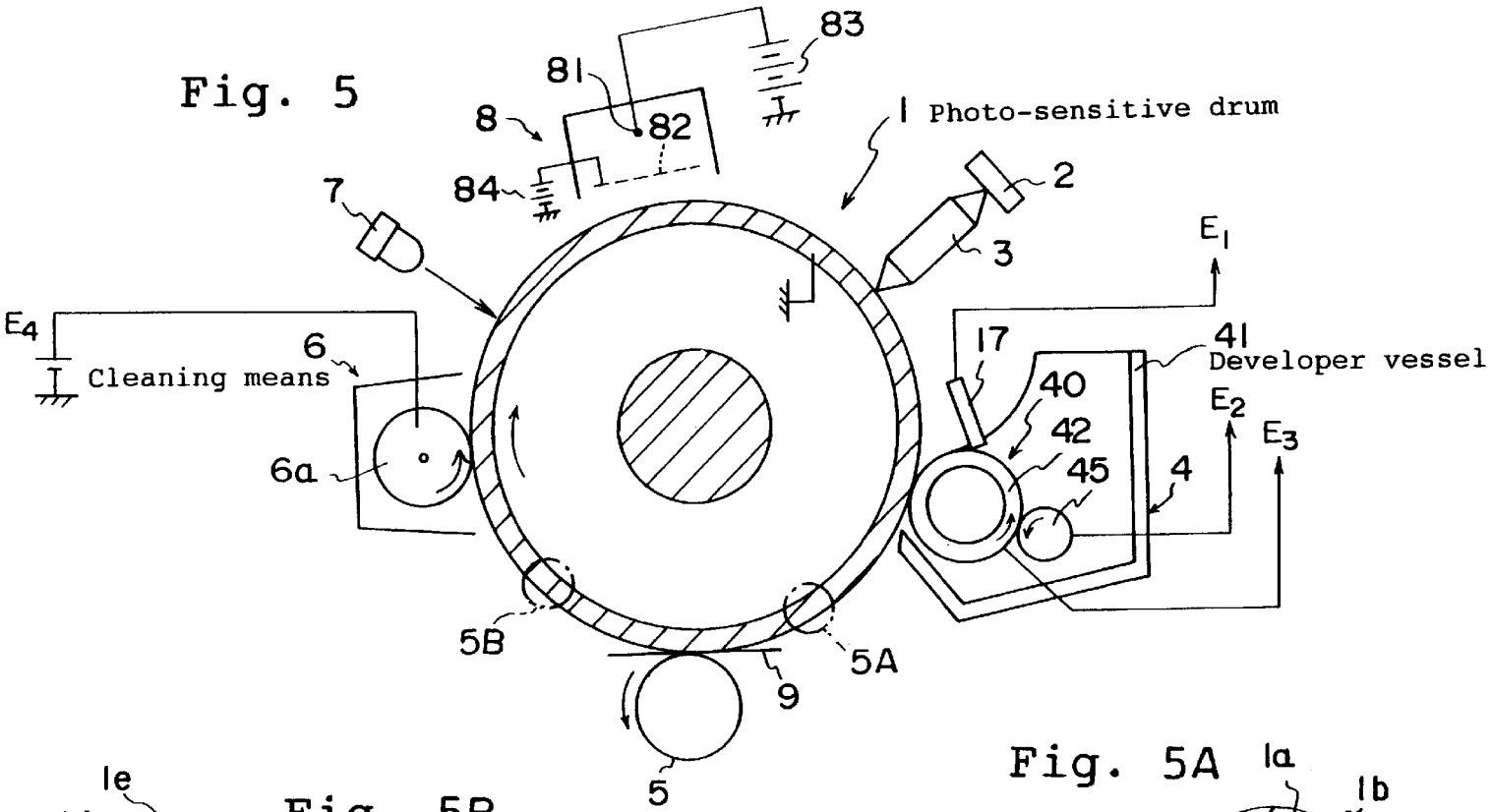
FIG. 5 is a schematic view showing a second embodiment of the image forming apparatus according to the invention.

FIG. 5 shows a different embodiment of the invention, in which paper particle removing means is provided. Parts like those shown in FIG. 1 are designated by like reference numerals and symbols.

Figure 5A:
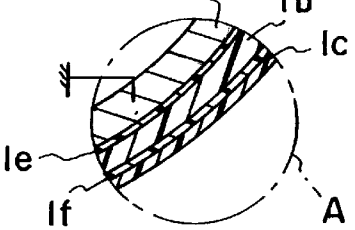
FIG. 5A is a partially enlarged cross-sectional view of laminated layers of a photo-sensitive drum in accordance with one embodiment of the present invention.
Figure 5B:
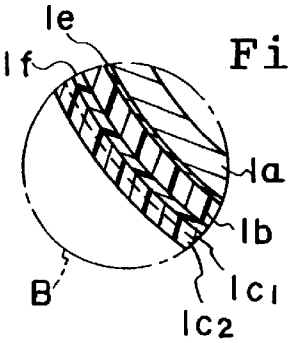
FIG. 5B is a partially enlarged cross-sectional view of laminated layers of the photo-sensitive drum in accordance with another embodiment of the present invention.

Referring to FIG. 5, the illustrated apparatus is the same as the apparatus shown in FIG. 1 except for that it further comprises paper particle removing means (or cleaning means) 6. FIGS. 5A and 5B are partially enlarged cross-sectional views of a photo-sensitive drum having different laminated structures similar to those shown in FIGS. 1A and 1B, respectively. The paper particle removing means 6 is disposed downstream the transfer roller 5, and it is constituted as paper particle removing roller 6*a,* which is formed by winding such conductive fibers as polyester, acryle, carbon-containing lyon, nylon, vinylon, etc. around a rotational shaft or into the form of a rotational roller. The paper particle removing roller 6*a* is disposed such that its outer periphery is in contact with the surface of the photo-sensitive drum 1, and is rotated in the opposite direction to the direction of rotation of the drum 1 at the contact position. The roller 6*a* is maintained at a voltage $E_4$.

Paper particles of a recording sheet 9 are not brought into so close contact with the photo-sensitive drum 1 as the toner, and thus can be removed by the paper particle removing roller 6*a* with a weaker force than the force for removing the toner.

The paper particle removing roller 6*a* of the paper particle removing means 6 is made of a conductive material, and thus it can also serve as a discharging roller in lieu of the discharging lamp 7 for discharging the surface of the photo-sensitive drum 1. It is further possible to dispense with the discharging lamp 7 and the charging unit 8 and charge the drum 1 with the roller 6*a*.

The transfer roller 5 is rotated at a higher peripheral speed than the peripheral speed of the photo-sensitive drum 1 at the transfer position. The transfer roller 5 thus applies a dynamic pushing force to the back surface of the recording sheet, and its wide area pushes the back surface of the recording sheet. The transfer efficiency thus can be improved.

With the transfer roller 5 brought into forced contact with the recording sheet 9, paper particles are separated therefrom. The separated particles are attached to the surface of the photo-sensitive drum 1 and conveyed to the position of the paper particle removing means 6 downstream the transfer roller 5.

The paper particle removing roller 6*a* of the paper particle removing means 6, which has its outer periphery in contact with the surface of the photo-sensitive drum 1 and is rotated in the opposite direction to the direction of rotation of the photo-sensitive drum 1 at its position of contract with the drum and removes the paper particles from the drum 1, because the paper particles are not in so close contact with the drum 1 as the toner.

Figure 4:
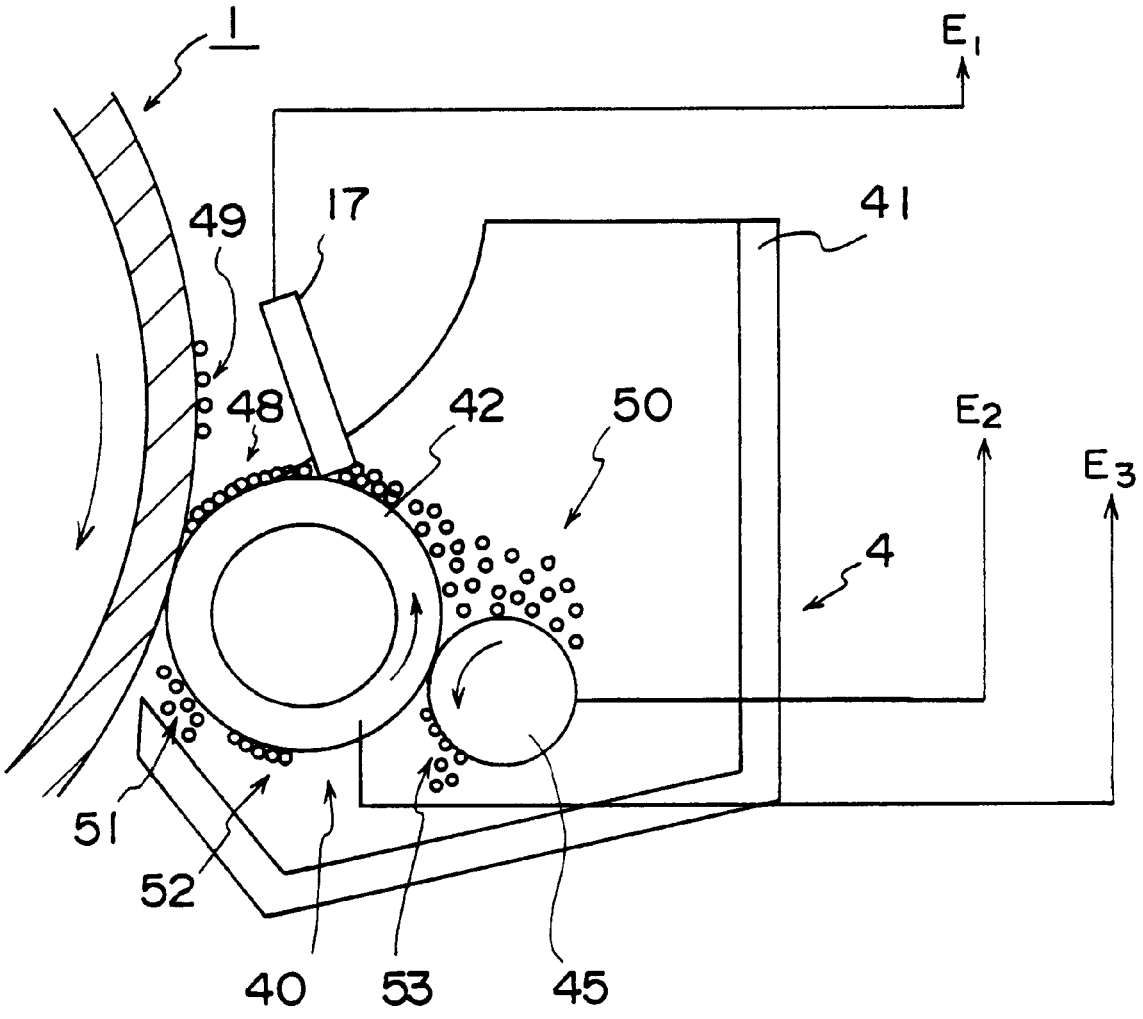
FIG. 4 is a schematic view showing the internal construction of a developer vessel.

In the meantime, as shown in FIG. 4, residual toner 49 which remains on the photo-sensitive drum 1 without being transferred to the recording sheet 9, is brought into contact again with the elastic member 42 of the developing roller 40.

Since the developing roller 40 is rotating at a higher peripheral speed than the peripheral speed of the photo-sensitive drum 1 at its position of contact with the drum 1, its elastic member 42 of the developing roller 40 rubs off the residual toner 49, as shown by reference numeral 51, from the drum 1, while a latent image on the surface of the drum 1 is developed by fresh toner 48.

The rubbed-off toner 51 slightly contains photo-sensitive material particles resulting from the polishing of the surface of the photo-sensitive drum 1 and also paper particles.

While the residual toner 49 rubbed off by the developing roller 40 generally falls down as the rubbed-off toner 51 into the developer vessel 41, some of it may be attached to the surface of and carried by the elastic member 42 of the developing roller 40 as shown by reference numeral 52. When the toner 52 carried on the developing roller 40 comes to the nip between the developing and feed rollers 40 and 45, which are rotating in opposite directions and affecting each other, it is caused by the feed roller 45 to fall down and recovered in the developer vessel 41 as shown by reference numeral 53.

The recovered toner 53 is mixed with fresh toner 50 in the developer vessel 41. However, since its quantity is small compared to the quantity of the fresh toner, it is diluted. The recovered toner 53 is thus recirculated through the developer vessel 41, and injected into and agitated with fresh toner, in the neighborhood of an inlet, through which the fresh toner is supplied.

As described before, this embodiment comprises the cleaning means 6, which removes paper particles separated from the recording sheet attached on the photo-sensitive drum 1 before the transfer of the toner image formed on the drum onto the recording sheet. Thus, paper particles which are transferred from the drum 1 onto the developing roller 40 and recovered together with the residual toner therefrom into the developer vessel 41 is extremely reduced, thus extremely reducing the possibility that paper particles introduced into the toner disturbed image in the long use of the apparatus.

EXAMPLE 4

As the photo-sensitive drum, an a-Si photo-sensitive drum with a thickness of 25 $\mu$m was prepared. As the developing roller was conductive roller with a diameter of 18 mm, a volume resistivity of $5\times10^6$.Ω cm, and a surface roughness of 10 microns or below. The developing nip was set to about 1 mm. The linear speed of development was set to 120 mm/sec. (that is, the linear speed of the photo-sensitive drum was set to 60 mm/sec.) As the thickness regulating blade was selected one with a thickness of 1.3 mm and a resistivity of $10^4$.Ω cm or below. As the feed roller was selected one with a diameter of 12 mm, and a resistivity of $10^4$.Ω cm or below, and its nip with the developing roller was set to about 1 mm. As the biases, 350 V was applied to the thickness regulating blade, and 350 V to the feed roller. As the toner was used a polymerization toner prepared from a styrene acryile type material and with a mean particle diameter of 8 microns. The transfer current in the transfer roller 5 was set to 20 to 30 micro-amperes.

Image formation was evaluated by forming 5,000 running prints under the above measurement conditions and also normal temperature and relative humidity conditions and subsequently leaving for 8 hours the prints under high temperature and relative humidity conditions. The test was made repeatedly by varying the toner layer thickness on the developing roller with adjustment of the thickness regulating blade and varying the potential difference $V_S$ between the photo-sensitive drum and the developing roller.

FIG. 10 shows the results. As is seen from the figure, with a toner layer thickness of 0.2 mg/cm$^2$ the image density and the photo-sensitive drum rubbing effect were low, and flow of image was generated.

With as toner layer thickness of 1.0 mg/cm$^2$, on the other hand, the cleaning force was weak, residual toner remained, although slightly, on the photo-sensitive drum. With a toner layer thickness of 1.2 mg/cm$^2$ the fog removal electric field was high, the cleaning force was weak, and residual toner remained on the drum.

Thus, it will be seen that satisfactory images are obtainable when the toner layer thickness on the developing roller is 0.3 to 1.0 mg/cm$^2$, preferably 0.4 to 1.0 mg/cm$^2$, more preferably 0.4 to 0.8 mg/cm$^2$.

EXAMPLE 5

In this example, image formation was evaluated under the same conditions as in Example 4 except for that the rotational speed Of the developing roller, i.e., the peripheral speed ratio thereof with respect to the photo-sensitive drum, was varied. The toner layer thickness was set to 0.7 mg/cm$^2$.

FIG. 11 shows the results. It will be seen from the figure that with a peripheral speed ratio of 1.0 or below, flow of image was generated. Wit a peripheral speed ratio of 7.0, the torque of the developing roller was high, and the toner was charged insufficiently and greatly spattered in the apparatus.

Thus, it will be seen that satisfactory image density are obtainable when the peripheral speed ratio of the developing roller is 1.1 to 6.0 times, preferably 1.2 to 5.0 times.

EXAMPLE 6

In this example, image formation was evaluated under the same conditions as in Example 4 except for that the developing time (i.e., time taken by the point of contact between the developing roller and the photo-sensitive drum for revolving from one end to the other of the development nip) is varied by varying the linear speed of the drum (linear velocity of photo-sensitive drum), the development nip and the rotational speed of the developing roller. The toner layer thickness was set to 0.7 mg/cm$^2$.

FIG. 12 shows the result. As is seen from the figure, at a high linear speed of the drum of 150 mm/sec. or above, the developing efficiency, rubbing efficiency and image density were reduced with a development nip width of 1.5 mm or below and a developing time of 0.01 sec. or below. In this case, flow of image was recognized.

At a drum linear speed of 25 mm/sec. or below, a great torque was applied by the developing roller with a development nip width of 2 mm or above and with an a developing time of 0.8 sec or above.

Thus, it will be seen that satisfactory image formation is obtainable at a drum linear speed of 25 to 150 mm/sec., with a development nip width of 1.5 to 2 mm and with a developing time of 0.01 to 0.08 sec or above.

EXAMPLE 7

In this example, 5,000 running prints were produced under the same conditions as in Example 4 and also under normal temperature and relative humidity conditions and then left under high temperature and relative humidity conditions for 8 hours, and image formation was evaluated. The test was made repeatedly by varying the toner layer thickness on the developing roller with adjustment of the thickness regulating blade and varying the potential difference $V_t$ between the developing roller and the feed roller.

FIG. 13 shows the result. As is seen from the figure, with a potential difference $V_t$ of 30 V between the developing roller and the feed roller, the image density and the rubbing effect of the photo-sensitive drum were low, and flow of image was generated.

With a potential difference $V_t$ of 300 V, the cleaning force was weak, and slight residual toner was remained on the photo-sensitive drum.

With a potential difference $V_t$ of 400 V, the fog-free electric field was high, the cleaning force was weak, and residual toner remained on the photo-sensitive drum.

Thus, it will be seen that satisfactory images are obtainable when the potential difference Vt between the developing roller and the feed roller is 40 to 300 V, Preferably 50 to 300 V, more preferably 50 to 200 V.

EXAMPLE 8

In this example, the same conditions for measurement as in Example 4 were set except for using as well a toner, which was prepared by obtaining a polymerization toner of a styrene acryle type material with a mean particle diameter of 8 microns and comminuting this toner.

The polymerization toner and comminution toner were compared concerning the transfer efficiency under normal temperature and relative humidity conditions (N/N), i.e., at a temperature of 20° C. and under a relative humidity of 60%, and high temperature and relative humidity conditions (L/L), i.e., at a temperature of 33° C. and under a relative humidity of 85%.

FIG. 14 shows the result. As is seen from the figure, the polymerization toner is superior in the transfer efficiency to the comminution toner.

EXAMPLE 9

This example was carried out by using a photo-sensitive drum having a surface layer, which is of an element ratio composition represented as a-$Si_{1-x}C_x$:H, x being $0.95 \leqq x < 1$, and has an outer surface dynamic penetration hardness of 300 kgf/mm$^2$ or below, and the hardness of which is gradually increased as one goes inward from the outer surface. Under the same conditions as in Example 4, 5,000 running prints were produced at normal temperature and left at a temperature of 33° C. and under a relative humidity of 85% for 8 hours or above, and then image formation was immediately evaluated. The images formed are found to be satisfactory and free form flow of image.

What is claimed is:

1. An electrophotographic image forming apparatus comprising a photo-sensitive drum made of amorphous silicon, the drum having a surface layer, a dynamic penetration hardness of the surface layer being higher on an inner side than on an outer surface, and a developing roller rotated in contact with the photo-sensitive drum via a layer of a non-magnetic uni-component toner, the volume resistivity of the developing roller being set to $3\times10^7\Omega$.cm or below.

2. The image forming apparatus according to claim 1, wherein the surface layer of the amorphous silicon photo-sensitive drum has an element ratio composition represented as (a-$Si_{1-x}C_x$:H), x being $0.95 \leqq x < 1$, the dynamic penetration hardness of the outer surface of the surface layer being 300 kgf/mm$^2$ or below, and the developing roller being rotated while carrying the non-magnetic uni-component toner and at a peripheral speed different from that of the photo-sensitive drum, thereby causing the carried toner to rub the surface of the photo-sensitive drum so as to obtain electrophotographic development, the surface potential on the photo-sensitive drum surface being set to substantially 400 V or below, the developing bias voltage applied to the developing roller being set to substantially 150 V or below.

3. The image forming apparatus according to claim 1, wherein the surface layer of the amorphous silicon photo-sensitive drum has an element ratio composition represented as (a-$Si_{1-x}C_x$:H), x being $0.95 \leqq x < 1$, the dynamic penetration hardness of the outer surface of the surface layer being 300 kgf/mm$^2$ or below, and the developing roller being rotated while carrying the non-magnetic uni-component toner and at a peripheral speed different from that of the photo-sensitive drum, thereby causing the carried toner to rub the surface of the photo-sensitive drum, while causing the particles of the toner to polish the photo-sensitive drum surface, thereby obtaining electrophotographic development.

4. The image forming apparatus according to claim 3, wherein the developing roller is feed forward rotated at a developing position at a higher peripheral speed than the peripheral speed of the photo-sensitive drum.

5. The electrophotographic apparatus according to claim 4, wherein the width of a nip formed on the developing position between the developing roller and the photo-sensitive drum is set to 0.5 mm or above.

6. The electrophotographic image forming apparatus of claim 1, wherein the non-magnetic uni-component toner is prepared by a polymerization process.

7. An electrophotographic image forming apparatus comprising a photo-sensitive drum made of amorphous silicon, a developing roller rotated in contact with the photo-sensitive drum via a layer of a non-magnetic uni-component toner, the volume resistivity of the developing roller being set to $3\times10^7\Omega$.cm or below, the image forming apparatus performing development while forming the non-magnetic uni-component toner layer on the developing roller, and a paper particle removing device for removing paper particles attached to the photo-sensitive drum surface after transferring a toner image formed by electrophotographic development on the photo-sensitive drum onto a recording medium, the paper particle removing device being disposed on the photo-sensitive drum between a transferring position and a developing position, a toner layer density accumulated on the developing roller being set to 0.3 to 0.9 mg/cm$^2$ at the developing position.

8. The image forming apparatus according to claim 7, which further comprises a transfer roller for transferring toner image from the photo-sensitive drum, the transfer roller being rotated at a higher peripheral speed than the peripheral speed of the photo-sensitive drum.

9. The image forming apparatus according to claim 7, which further comprises a feed roller rotated in frictional contact with the developing roller for supplying toner into a developer vessel, the direction of rotation of the feed roller being set to be the same as the direction of rotation of the developing roller, a toner supply voltage being applied between the developing roller and the feed roller, the toner supply voltage being of the same polarity as a tribo-electrificational electrode of the toner and set to 30 to 300 V.

10. The image forming apparatus according to claim 7, wherein the peripheral speed of the developing roller is set to 1.2 to 5.0 times to the peripheral speed of the photo-sensitive drum.

11. The image forming apparatus according to claim 7, wherein the time of contact between the photo-sensitive drum and the developing roller is set to 0.01 to 0.1 second.

12. An electrophotographic image forming apparatus comprising a photo-sensitive drum made of amorphous silicon, and a developing roller rotated in contact with the photo-sensitive drum via a layer of a non-magnetic uni-component toner, the volume resistivity of the developing roller being set to $3\times10^7\Omega$.cm or below, the developing roller being rotated while carrying the non-magnetic uni-component toner and at a peripheral speed different from that of the photo-sensitive drum.

13. The electrophotographic image forming apparatus of claim 12, wherein the developing roller scribes off residual toner remained on the photo-sensitive drum while the image is being formed on the photo-sensitive drum.

14. The electrophotographic image forming apparatus of claim 12, wherein the non-magnetic uni-component toner is prepared by a polymerization process.

15. The electrophotographic image forming apparatus of claim 12, wherein the roller portion of the developing roller is made from elastic rubber.

16. The electrophotographic image forming apparatus of claim 15, wherein the developing roller rotates at a higher peripheral speed than that of the photo-sensitive drum.

17. An electrophotographic image forming apparatus comprising:

a photo-sensitive drum made of amorphous silicon, the drum having a surface layer defining an outer surface and an inner side deeper than the outer surface, a dynamic penetration hardness of the surface layer being higher on the inner side than on the outer surface;

a developing roller rotated in contact with the photo-sensitive drum via a layer of a non-magnetic uni-component toner for forming an image of the non-magnetic uni-component toner layer on the photo-sensitive drum, the volume resistivity of the developing roller being set to $3\times10^7\Omega$.cm or below;

a transfer device for transferring the image of the non-magnetic uni-component toner formed on the photo-sensitive drum onto a recording medium; and a polishing device being disposed between the transfer device and the developing roller and in sliding contact with the outer surface of the photo-sensitive drum for polishing the outer surface of the photo-sensitive drum, while the image is being formed on the photo-sensitive drum.

18. The electrophotographic image forming apparatus of claim 17, wherein the non-magnetic uni-component toner is prepared by a polymerization process.

* * * * *